US009121662B1

(12) United States Patent
Love

(10) Patent No.: US 9,121,662 B1
(45) Date of Patent: Sep. 1, 2015

(54) RACKING DEVICE FOR RACKING SLIDE OF SEMI-AUTOMATIC PISTOL

(71) Applicant: Michael D. Love, Salem, VA (US)

(72) Inventor: Michael D. Love, Salem, VA (US)

( * ) Notice: Subject to any disclaimer, the term of this patent is extended or adjusted under 35 U.S.C. 154(b) by 0 days.

(21) Appl. No.: 14/511,304

(22) Filed: Oct. 10, 2014

(51) Int. Cl.
*F41A 15/00* (2006.01)
*F41C 27/00* (2006.01)

(52) U.S. Cl.
CPC ..... *F41C 27/00* (2013.01)

(58) Field of Classification Search
CPC .. F41C 27/00; F41C 33/0263; F41C 33/0209; Y10S 224/912
USPC ..... 224/242, 243; 42/90, 106
See application file for complete search history.

(56) References Cited

U.S. PATENT DOCUMENTS 3,804,306 A 4/1974 Azurin
3,847,315 A * 11/1974 Bianchi ..... 224/616
4,043,065 A * 8/1977 Musgrave ..... 42/106
4,138,044 A * 2/1979 Musgrave ..... 224/242
4,298,150 A * 11/1981 Seldeen ..... 224/243
5,467,909 A * 11/1995 Resca et al. ..... 224/244
5,622,295 A * 4/1997 Hellweg et al. ..... 224/193
8,549,785 B2 10/2013 Sharp et al.
8,646,665 B2 * 2/2014 Abushaev ..... 224/243
2007/0163164 A1 7/2007 Avrahami et al.
2013/0306691 A1 * 11/2013 Baumann et al. ..... 224/244

* cited by examiner

*Primary Examiner* — Samir Abdosh
(74) *Attorney, Agent, or Firm* — Kilyk & Bowersox, P.L.L.C.

(57) ABSTRACT

A racking device is provided that can assist an individual with racking a pistol, using only one hand. The device includes a slide channel that narrows in a direction toward an intersection with a barrel channel. The narrowing enables the slide channel to receive any of a wide variety of pistols and to restrain the slide portion, or slide, thereof from moving past the intersection. The barrel channel is wide enough to accommodate the pistol barrel but not the slide. A pistol can be positioned in the slide channel and forced into the device so that the pistol barrel moves into the barrel channel while the slide is restrained by the slide channel, thereby racking the pistol with a single hand. A belt clip and a surface mount are also provided for mounting the device and stabilizing the device during use.

20 Claims, 7 Drawing Sheets

RACKING DEVICE FOR RACKING SLIDE OF SEMI-AUTOMATIC PISTOL

FIELD OF THE INVENTION

The present invention relates to a device for racking a semi-automatic pistol.

BACKGROUND OF THE INVENTION

Racking devices are used to assist an operator in racking a semi-automatic pistol. U.S. Pat. No. 3,804,306 to Azurin describes a pistol holster that cocks a pistol as it withdrawn from a holster. U.S. Pat. No. 4,043,065 to Musgrave describes a pistol charging socket that can be made integral with a holster or pouch. These racking devices, however, are not universally useful for a wide range of pistols, cannot easily be used by either left-handed and right-handed operators, and each device requires a withdrawing action to pull the pistol out of the holster or out of the socket. A need exists for a racking device that overcomes these limitations and that can be used to very quickly rack a pistol with a single hand and using a simple motion.

SUMMARY OF THE INVENTION

According to one or more embodiments of the present invention, a racking device is provided for racking a rackable pistol, such as a semi-automatic pistol. The racking device can be used with a single hand to rack a pistol, and can be used, without modification, by left-handed or right-handed pistol operators. The racking device has an open channel that enables racking a pistol by using a very simple forward motion of the pistol, and does not require withdrawing the pistol from a holster or socket.

The racking device can comprise a frame defining a slide channel and a barrel channel that intersect with one another at an intersection. The slide channel can have a length and a width, comprise an entry end, an exit end, and opposing channel edges, and be configured to accommodate the slide of a rackable pistol. The exit end intersects with the barrel channel and the slide channel width decreases in a direction from the entry end toward the intersection along at least a portion of the length of the slide channel. The opposing channel edges are separated by a decreasing separation distance, in a direction toward the intersection, along at least a portion of the length of the slide channel. The barrel channel can have a length, comprise a barrel channel wall and opposing channel edges, and be configured to accommodate the barrel of the pistol. The opposing channel edges of the barrel channel can be separated substantially equidistantly along the length of the barrel channel. The frame can be mounted on or to a belt clip, a surface mounting bracket, or the like.

According to yet further embodiments of the present invention, a method is provided for racking a pistol having a slide portion, also known as a "slide," and a barrel. The method comprises first positioning the slide of a pistol in the slide channel of the racking device described herein. One or more sides of the slide can be made to contact the slide channel. The method then comprises pushing the barrel of the pistol into the barrel channel. The slide channel prevents movement of the slide into the barrel channel as the pistol barrel extends into the barrel channel. As a result, the pistol is racked and the method can be carried out using just one hand.

BRIEF DESCRIPTION OF THE DRAWINGS

The present invention can be even more fully understood with the reference to the accompanying drawings which are intended to illustrate, not limit, the present invention.

DETAILED DESCRIPTION OF THE INVENTION

Figure 1:
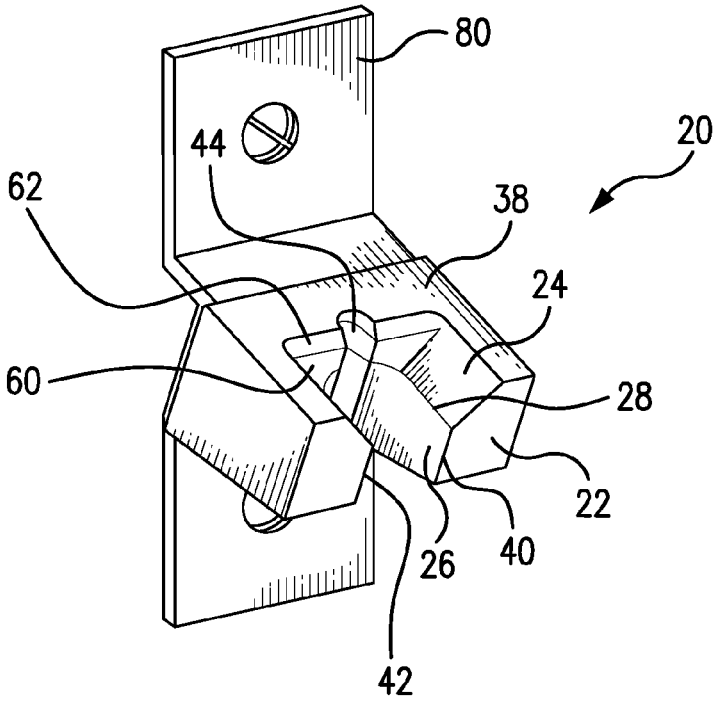
FIG. 1 is a top, front, perspective view of a pistol racking device according to one or more embodiments of the present invention, mounted on a surface mounting bracket.

According to one or more embodiments of the present invention, a racking device for racking the slide of a pistol is provided. The racking device can comprise a frame, for example, a solid block, defining or otherwise having formed therein a slide channel and a barrel channel that intersect with one another. The slide channel has a length and a width and comprises an entry end, an exit end, and opposing channel edges. The channel edges can form angled edges at a surface of the frame, for example, at the intersection with a planar surface of a solid block. The slide channel is configured to accommodate the slide of a rackable pistol and the exit end can intersect directly with the barrel channel. The intersection can comprise a transition, for example, an angled surface, a curved surface, a beveled surface, a groove, a surface irregularity, a combination thereof, or the like. The slide channel can have a width that decreases in a direction from the entry end toward the intersection, at least along a portion of the length of the slide channel. The entire length of the slide channel can be defined by a width that continuously decreases along the entire length of the slide channel. Going in a direction toward the intersection, the opposing channel edges of the slide channel can be separated by a decreasing separation distance along the entire length of the slide channel, or along just a portion of the length of the slide channel.

The barrel channel has a length and comprises a barrel channel wall and opposing channel edges. The barrel channel is configured to accommodate the barrel of a rackable pistol. The barrel channel can have any suitable cross-sectional shape, for example, an arch-shaped cross-section. The opposing channel edges can be separated substantially equidistantly along the entire length of the barrel channel, or along just a portion of the length of the barrel channel.

The barrel channel can have a maximum width. The maximum width can be equal to the distance separating the opposing channel edges of the barrel channel. In some cases, the maximum width can be greater than the distance separating the opposing channel edges of the barrel channel.

The slide channel can be configured such that, at any cross section taken perpendicularly along the length of the slide channel, the slide channel has a maximum width that is equal to the distance separating the opposing channel edges of the slide channel.

The frame can comprise a solid block and the slide channel and barrel channel can be formed in a surface of the solid block. The surface can be planar, curved, patterned, surface-featured, rounded, spherical, or the like. The frame can comprise a solid block of a metal material, for example, aluminum, brass, iron, steel, an alloy, or the like. The block can be made of a polymeric material, for example, a polytetrafluoroethylenic material, a resin material, a filled polymeric material, a thermoplastic material, a combination thereof, or the like.

The frame can define a planar surface, and the slide channel and the barrel channel can be formed in the planar surface such that each channel extends to a respective maximum depth that is perpendicular to the planar surface.

The width of the slide channel can continuously decrease from the entry end to the intersection. The width of the slide channel can continuously decrease at a constant rate from the entry end to the intersection. The barrel channel can have an appropriate width for accommodating one or more different pistols. The barrel channel can have a maximum width of about 0.5 inch, of about 0.625 inch, of about 0.750 inch, for example. The barrel channel can have a depth of about 0.375 inch, 0.5 inch, 0.625 inch, 0.75 inch, 0.825 inch, 1.0 inch, or the like. The barrel channel can have a groove formed therein that is configured to accommodate a pistol sight as a pistol slide is moved into the slide channel.

Instead of a solid block, the frame can comprise a hollow member that has been shaped to define a slide channel and a barrel channel.

A mounting clip can be provided that is configured to be attached to a waist belt, and the frame can be configured to be mounted to the mounting clip. A surface mounting bracket can be provided that is configured to be attached to a surface, and the frame can be mounted to the surface mounting bracket.

The barrel channel can have a substantially arched-shaped cross-section along the length thereof, for example, the barrel channel can have two opposing, planar, parallel, sidewalls.

According to various embodiments of the present invention, the racking device can be mounted in, on, or at, a pistol clearing station. According to various embodiments of the present invention, the racking device can be mounted in, on, or at, a ballistics sampling station.

According to yet further embodiments of the present invention, a method is provided for racking a pistol having a slide and a barrel. The method comprises first positioning the slide of a pistol in the slide channel of the racking device described herein. One or more sides of the slide can be made to contact the slide channel. The method then comprises pushing the barrel of the pistol into the barrel channel. The slide channel prevents movement of the slide into the barrel channel as the pistol barrel extends into the barrel channel. As a result, the pistol is racked and the method can be carried out using just one hand.

Referring now to the drawing figures, FIG. 1 is a top, front, perspective view of a pistol racking device 20 according to one or more embodiments of the present invention. Racking device 20 is mounted on a surface mounting bracket 80 that, in-turn, can be mounted to a surface, for example, underneath a nightstand, underneath an end table, underneath a desk, on a wall, to a wheelchair, to a piece of furniture, or to a like surface or object. Racking device 20 comprises a frame 22, exemplified as a solid block. Frame 22 can comprise a metal material, a plastic material, or the like. Frame 22 can comprise aluminum, for example, anodized aluminum. Frame 22 has formed therein a slide channel 24 and a barrel channel 26 that intersect with one another at an intersection 28.

Figure 2:
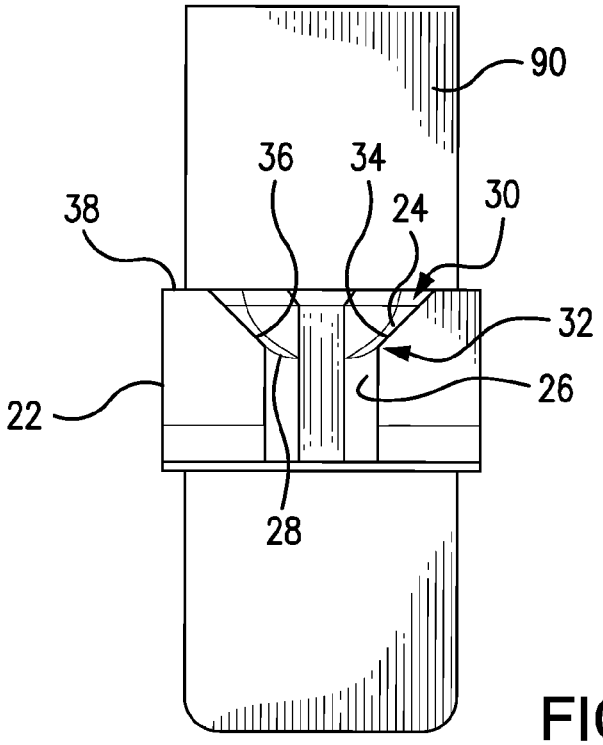
FIG. 2 is a front view of the racking device shown in FIG. 1, but mounted on a belt clip.

FIG. 2 is a front view of the racking device shown in FIG. 1, but mounted on a belt clip 90 instead of a surface mounting bracket. As can be seen in FIG. 2, slide channel 24 has a length and a width and comprises an entry end 30, an exit end 32, and opposing channel edges 34 and 36. Channel edges 34 and 36 form angled edges that begin at entry end 30 at an intersection of slide channel 24 with a surface 38 of frame 22. In the example shown, surface 38 is a planar surface of frame 22. Slide channel 24 is configured to accommodate the slide of a rackable pistol, and narrows to prevent the slide from entering barrel channel 26. Exit end 32 intersects directly with barrel channel 26 at intersection 28. Slide channel 24 has a width that decreases in a direction from entry end 30 toward intersection 28.

Figure 3:
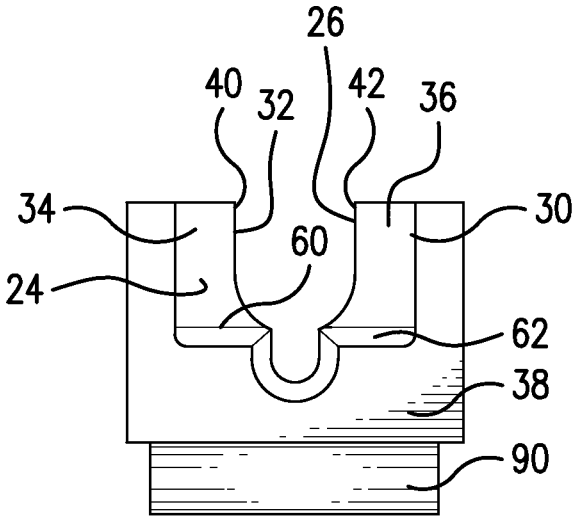
FIG. 3 is a top view of the racking device on the belt clip, shown in FIG. 2.

In the example shown, the entire length of slide channel 24 is defined by a width that continuously decreases from entry end 30 to exit end 32. Going in a direction toward the intersection, opposing channel edges 34 and 36 of slide channel 24 are separated by a decreasing separation distance along the entire length of slide channel 24. At any cross-section taken perpendicularly along the length of the slide channel, the slide channel has a maximum width that is equal to the distance separating the opposing channel edges of the slide channel. As shown in FIGS. 1 and 3, each of opposing channel edges 34 and 36 of slide channel 24 intersects with a sidewall 60 of slide channel 24. Sidewall 60 can be provided with a beveled edge 62 where sidewall 60 intersects with planar surface 38 of frame 22. Opposite sidewall 60, slide channel 24 does not have an opposing sidewall, but instead, is open such that slide channel 24 is an open channel, not a socket, tube, or surrounded passageway.

Slide channel 24 has a pistol sight groove 44 formed therein that is configured to accommodate a pistol sight as a pistol is moved into the racking device. Pistol sight groove 44 has a substantially arched-shaped cross-section along the length thereof, and two opposing, planar, parallel, sidewalls, although other shapes and cross-sections can be used. Pistol sight groove 44 has a tapered or beveled edge where it intersects with planar surface 38 of frame 22.

Figure 4:
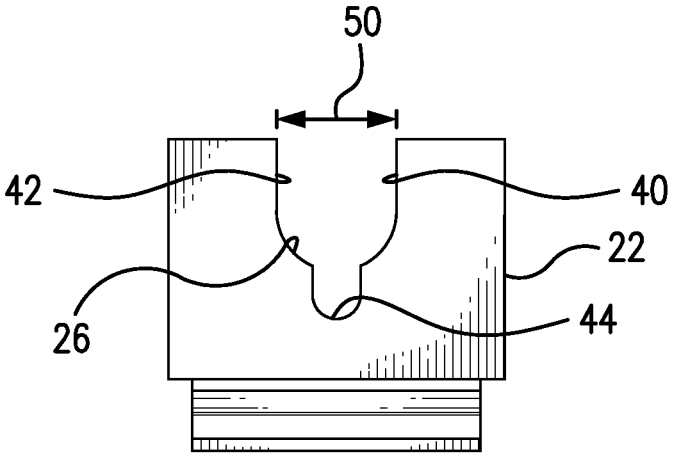
FIG. 4 is a bottom view of the racking device on the belt clip, shown in FIGS. 2 and 3.
Figure 5:
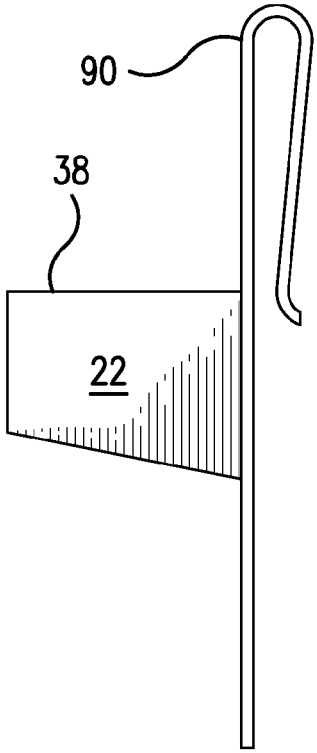
FIG. 5 is a right, side view of the racking device on the belt clip, shown in FIGS. 2-4.
Figure 6:
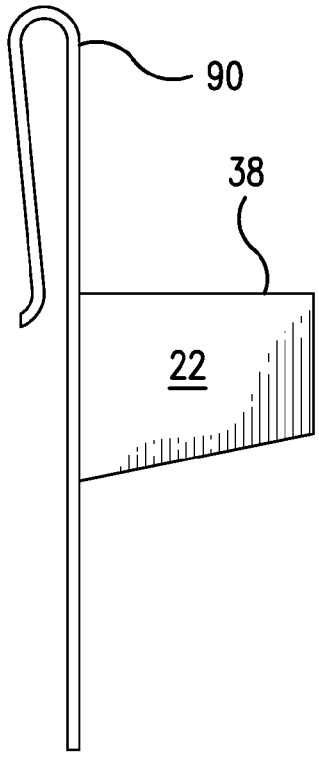
FIG. 6 is a left, side view of the racking device on the belt clip, shown in FIGS. 2-5.
Figure 7:
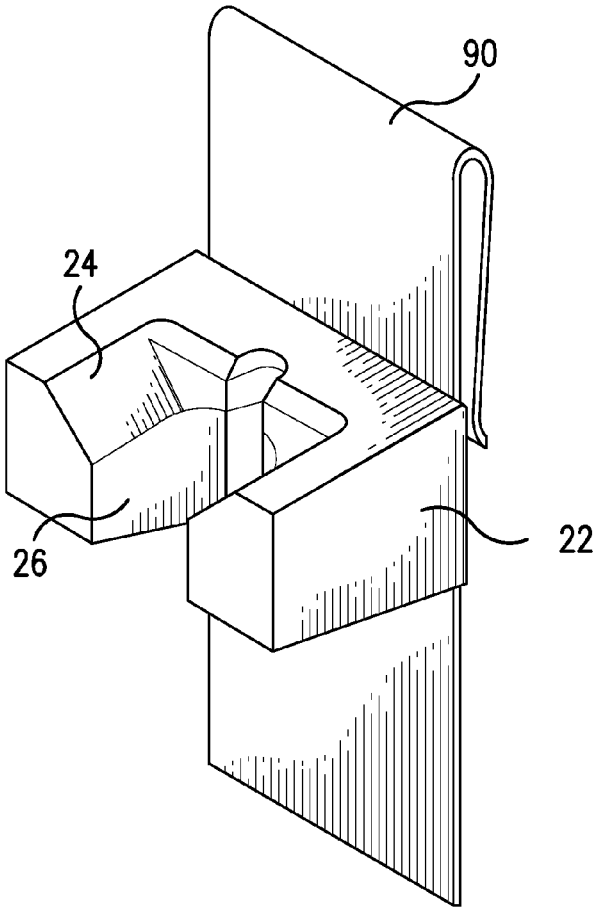
FIG. 7 is a right, top, perspective view of the racking device on the belt clip, shown in FIGS. 2-6.

Barrel channel 26 has a length and comprises a barrel channel wall and opposing channel edges 40 and 42 (FIGS. 1, 3, and 4). Barrel channel 26 is configured to accommodate the barrel of a rackable pistol. Barrel channel 26 is exemplified in the drawings as having an arch-shaped cross-section. FIG. 3 is a top view of the racking device on the belt clip, shown in FIG. 2. FIG. 4 is a bottom view of the same racking device, FIG. 5 is a right-side view of the same racking device, FIG. 6 is a left-side view of the same racking device, and FIG. 7 is a right, top, perspective view of the same racking device. As shown, particularly in FIG. 4, opposing channel edges 40 and 42 are separated substantially equidistantly by a distance 50, along the entire length of the barrel channel. The maximum width of the barrel channel is equal to distance 50 separating opposing channel edges 40 and 42. Barrel channel 26 has a continuation of pistol sight groove 44, formed therein, that is configured to accommodate a pistol sight as a pistol is moved into the racking device. Pistol sight groove 44 also has a substantially arched-shaped cross-section along its length in the barrel channel, although a specific shape and length of the pistol sight grove 44 in the barrel channel is not necessary. A pistol sight is, however, typically restrained with the slide of the pistol, in the slide channel, thus preventing the pistol sight from ever entering the barrel channel. For ease of machining, pistol sight groove 44 can be formed along the entire length of the barrel channel.

Figure 8:
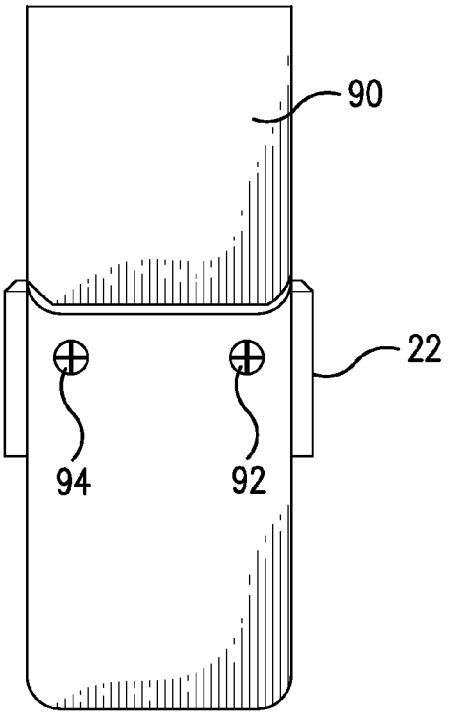
FIG. 8 is a back view of the racking device on the belt clip, shown in FIGS. 2-7.

The racking device can be mounted on a belt clip, on a surface mounting bracket, directly to a surface, directly to a belt, to a pistol clearing station, to a ballistics testing station, or at or on a like location, surface, wearable article, or station. FIG. 8 is a back view of the racking device on the belt clip, shown in FIGS. 2-7. As can be seen, two bolts 92 and 94 are used to secure frame 22 to belt clip 90. Other fasteners can instead, or additionally, be used to secure the frame and/or racking device to a belt clip.

Figure 9:
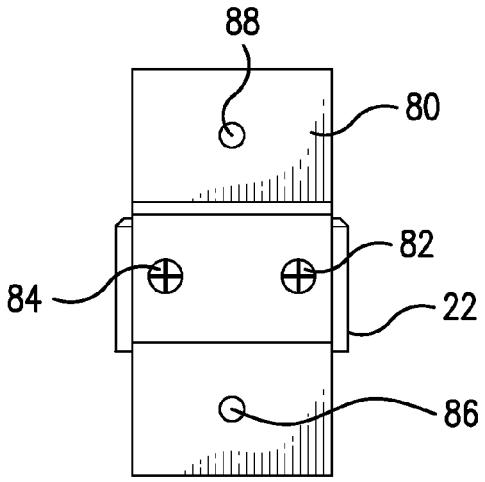
FIG. 9 is a back view of the racking device on the surface mounting bracket, shown in FIG. 1.

FIG. 9 shows another mounting option and is a back view of the device and bracket shown in FIG. 1. Frame 22 is shown secured to surface mounting bracket 80, by two bolts 82 and 84. Other fasteners can instead, or additionally, be used to secure the frame and/or racking device to a surface mounting bracket. Surface mounting bracket 80 is provided with two holes 86 and 88 through which screws, bolts, nails, or other fasteners can be used to secure the surface mounting bracket to a surface, for example, to a furniture surface, to a vest surface, to a surface of a wearable article, to a pistol station surface, or the like.

Figure 10:
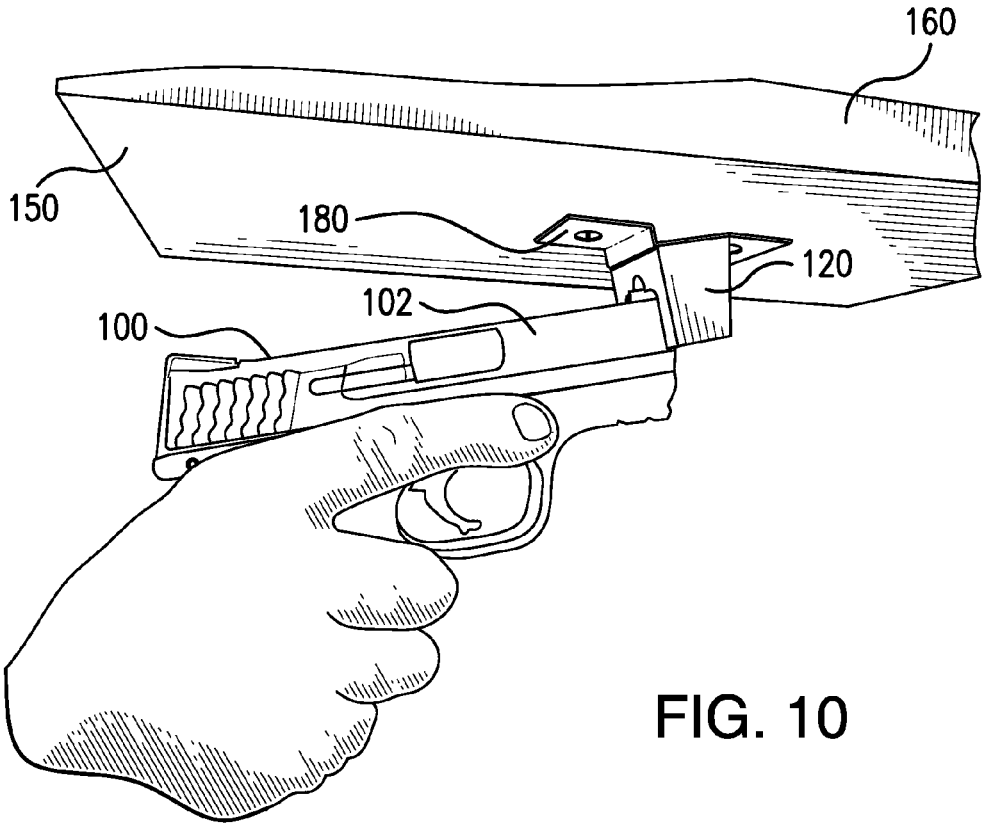
FIG. 10 is a side view showing a first step for racking a pistol using a racking device mounted on a surface mounting bracket according to a method of the present invention.
Figure 11:
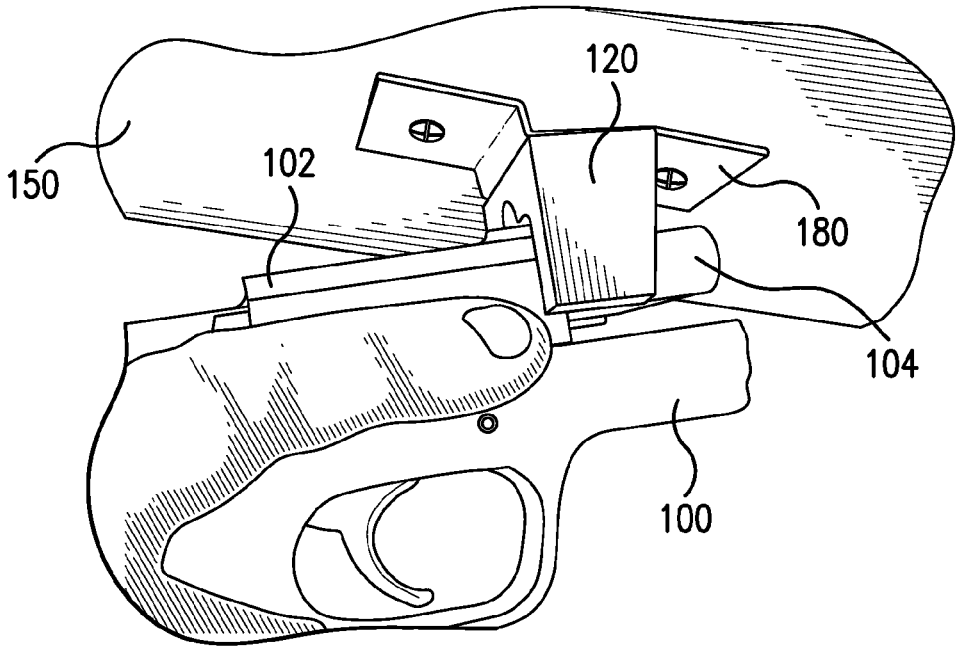
FIG. 11 is a side view showing a second step for racking a pistol according to the method shown in FIG. 10.

According to yet further embodiments of the present invention, a method is provided for racking a pistol having a slide and a barrel. FIG. 10 is a side view showing a first step for racking a pistol 100 according to a method of the present invention, and FIG. 11 is a side view showing the second step involved with the method. The method comprises first positioning a slide 102 of pistol 100 in the slide channel of a racking device 120 as described herein. Racking device 120 is shown attached to a surface mounting bracket 180, which, in-turn, is mounted to an underside surface 150 of a nightstand 160. One or more sides of slide 102 can be made to contact the slide channel of racking device 120, for example, opposite side surfaces and a top surface of slide 102 can all contact the slide channel of racking device 120. The method then comprises pushing pistol 100 further into racking device 120 such that pistol barrel 104 extends into the barrel channel of racking device 120. The slide channel prevents movement of slide 102 into the barrel channel as pistol barrel 104 extends into the barrel channel. As a result, pistol 100 can be racked and the method can be carried out using just one hand. Once racked, the pistol can be pulled down, out of the slide channel and barrel channel, without a need to withdraw the pistol out of the racking device. As a result, a single, smooth, continuous motion can be used to position and push the pistol into the racking device and then pull the racked pistol out of the open channels.

Figure 12:
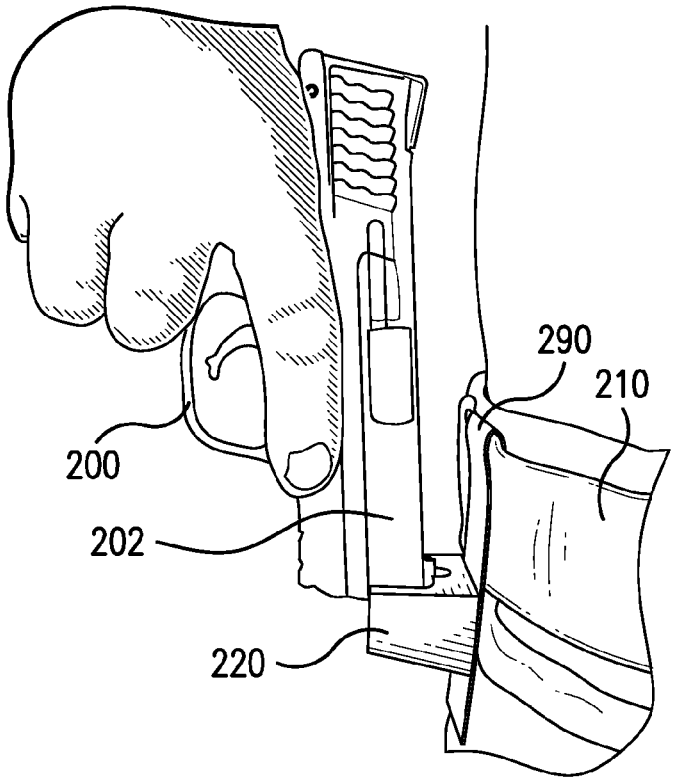
FIG. 12 is a side view showing a first step for racking a pistol using a racking device mounted on a belt clip, according to another method of the present invention.
Figure 13:
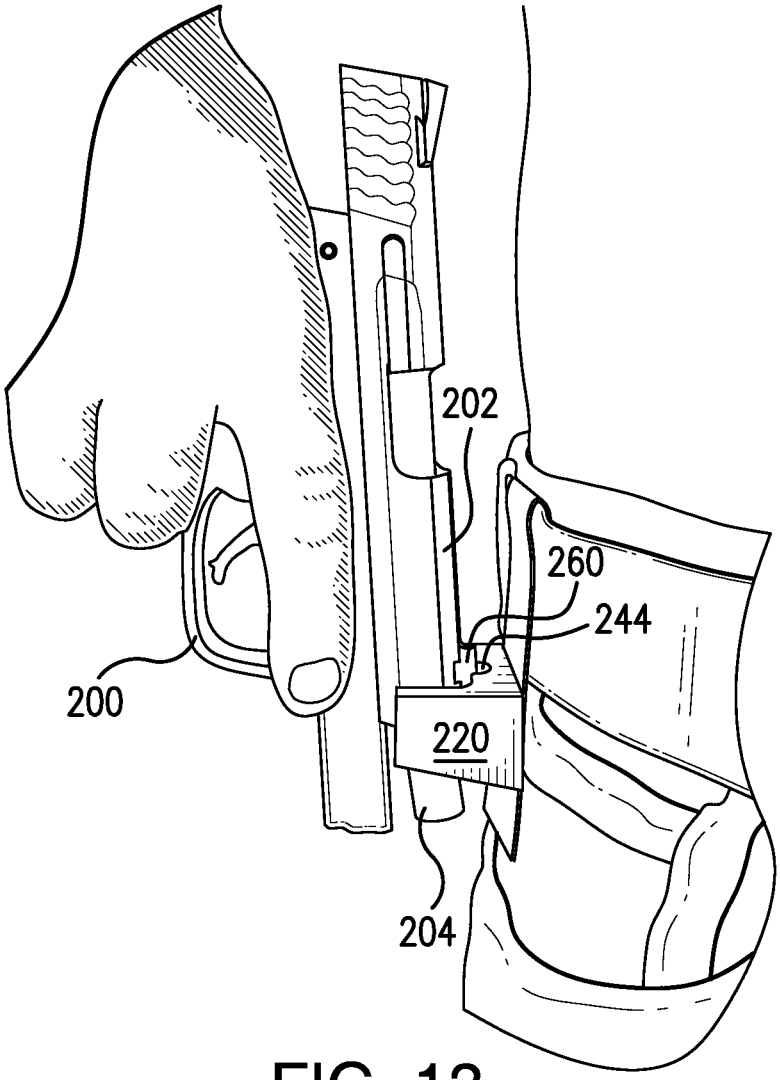
FIG. 13 is a side view showing a second step for racking a pistol according to the method shown in FIG. 12.

FIG. 12 is a side view showing a first step for racking a pistol using a racking device mounted on a belt clip, according to yet another embodiment of the present invention. FIG. 13 is a side view showing the second step of the method. As can be seen, a pistol 200 is placed in a racking device 220 in a manner that positions a slide 202 of pistol 200 in the slide channel of racking device 220. Racking device 220 is shown attached to a belt clip 290 that, in-turn, is secured to a belt 210 on the waist of an operator. One or more sides of slide 202 can be made to contact the slide channel of racking device 220, for example, opposite side surfaces and a top surface of slide 202 can all contact the slide channel of racking device 220.

Also shown in FIGS. 12 and 13 is a pistol sight groove 244 formed in the frame of racking device 220, and which is designed to accommodate a pistol sight 260 protruding from pistol 200. Pistol sight 260 can move into pistol sight groove 244, to any degree, without obstructing movement of slide 202 or pistol barrel 204. The method illustrated in FIGS. 12 and 13 can also comprise pushing pistol barrel 204 of pistol 200 into the barrel channel of racking device 220 as shown in FIG. 13. The slide channel prevents movement of slide 202 into the barrel channel as pistol barrel 204 extends into the barrel channel. As a result, pistol 200 can be racked by a simple downward then outward motion. The method can be carried out using just one hand. The belt clip can be positioned on the right-hand side or on the left-hand side of the operator's waist without any need for modification of the belt clip or racking device. The racking can be carried out much faster than racking with a holster or socket that would require a withdrawing action.

The present invention includes the following numbered aspects, embodiments, and features, in any order and/or in any combination:

1. A racking device of any preceding or following embodiment/feature/aspect for racking a slide of a rackable pistol, the racking device comprising a frame defining a slide channel and a barrel channel that intersect with one another at an intersection, wherein:

the slide channel has a length and a width, comprises an entry end, an exit end, and opposing channel edges, and is configured to accommodate the slide of a rackable pistol, the exit end intersects with the barrel channel, the slide channel width decreases in a direction from the entry end toward the intersection along at least a portion of the length of the slide channel, and the opposing channel edges are separated by a decreasing separation distance, in a direction toward the intersection, along at least a portion of the length of the slide channel, and the barrel channel has a length, comprises a barrel channel wall and opposing channel edges, and is configured to accommodate the barrel of a rackable pistol, the opposing channel edges being separated substantially equidistantly along the length of the barrel channel.

2. The racking device of any preceding or following embodiment/feature/aspect, wherein the barrel channel has a maximum width, the opposing channel edges of the barrel channel are separated by a distance, and the distance is equal to the maximum width.

3. The racking device of any preceding or following embodiment/feature/aspect, wherein the slide channel is configured such that, at any cross section taken perpendicularly through the slide channel, the slide channel has a maximum width, the opposing channel edges of the slide channel are separated by a distance, and the distance is equal to the maximum width.

4. The racking device of any preceding or following embodiment/feature/aspect, wherein the frame comprises a solid block and the slide channel and barrel channel are formed in a surface of the solid block.

5. The racking device of any preceding or following embodiment/feature/aspect, wherein the solid block comprises an aluminum material.

6. The racking device of any preceding or following embodiment/feature/aspect, wherein the frame defines a planar surface, the slide channel and the barrel channel are formed in the planar surface, and each of the channels extends to a respective maximum depth that is perpendicular to the planar surface.

7. The racking device of any preceding or following embodiment/feature/aspect, wherein the width of the slide channel continuously decreases from the entry end to the intersection.

8. The racking device of any preceding or following embodiment/feature/aspect, wherein the width of the slide channel continuously decreases at a constant rate from the entry end to the intersection.

9. The racking device of any preceding or following embodiment/feature/aspect, wherein the barrel channel has a maximum width of about 0.5 inch.

10. The racking device of any preceding or following embodiment/feature/aspect, wherein the barrel channel has a maximum width of about 0.625 inch.

11. The racking device of any preceding or following embodiment/feature/aspect, wherein the barrel channel has a maximum width of about 0.750 inch.

12. The racking device of any preceding or following embodiment/feature/aspect, wherein the slide channel has a groove formed therein that is configured to accommodate a pistol sight as a pistol slide is moved into the slide channel.

13. The racking device of any preceding or following embodiment/feature/aspect, wherein the frame comprises a hollow member.

14. The racking device of any preceding or following embodiment/feature/aspect, further comprising a mounting clip that is configured to be attached to a waist belt, and wherein the frame is mounted to the mounting clip.

15. The racking device of any preceding or following embodiment/feature/aspect, further comprising a surface mounting bracket that is configured to be attached to a surface, and wherein the frame is mounted to the surface mounting bracket.

16. The racking device of any preceding or following embodiment/feature/aspect, wherein the barrel channel has a substantially arched-shaped cross-section along the length thereof, and two opposing, planar, parallel, sidewalls.

17. A system comprising a pistol clearing station and the racking device of any preceding or following embodiment/feature/aspect, wherein the racking device is mounted in, on, or at, the pistol clearing station.

18. A system comprising a ballistics sampling station and the racking device of any preceding or following embodiment/feature/aspect, wherein the racking device is mounted in, on, or at, the ballistics sampling station.

19. A method of racking a pistol having a slide and a barrel, the method comprising:

positioning the slide of the pistol in the slide channel of the racking device of any preceding or following embodiment/feature/aspect, such that sides of the slide of the pistol contact the slide channel; and pushing the barrel of the pistol into the barrel channel while the slide channel prevents movement of the slide into the barrel channel, to rack the pistol.

20. The method of any preceding or following embodiment/feature/aspect, wherein the positioning and pushing are carried out with one hand.

The present invention can include any combination of these various features or embodiments above and/or below as set-forth in sentences and/or paragraphs. Any combination of disclosed features herein is considered part of the present invention and no limitation is intended with respect to combinable features.

The entire contents of all references cited in this disclosure are incorporated herein in their entireties, by reference. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether such ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. A racking device for racking a slide of a rackable pistol, the racking device comprising a frame defining an open slide channel and an open barrel channel that intersect with one another at an intersection, wherein:

the open slide channel has a length and a width, comprises an entry end, an exit end, and opposing channel edges, and is configured to accommodate the slide of a rackable pistol, the exit end intersects with the open barrel channel, the open slide channel width decreases in a direction from the entry end toward the intersection along at least a portion of the length of the open slide channel, the opposing channel edges are separated by a decreasing separation distance, in a direction toward the intersection, along at least a portion of the length of the open slide channel, and the open slide channel is not closed-in by a wall along the entire length of a side thereof, and the open barrel channel has a length, comprises an open barrel channel wall and opposing channel edges, and is configured to accommodate the barrel of a rackable pistol, the opposing channel edges being separated substantially equidistantly along the length of the open barrel channel and the open barrel channel is not closed-in by a wall along the entire length of a side thereof.

2. The racking device of claim 1, wherein the open barrel channel has a maximum width, the opposing channel edges of the open barrel channel are separated by a distance, and the distance is equal to the maximum width.

3. The racking device of the claim 1, wherein the open slide channel is configured such that, at any cross section taken perpendicularly through the open slide channel, the open slide channel has a maximum width, the opposing channel edges of the open slide channel are separated by a distance, and the distance is equal to the maximum width.

4. The racking device of claim 1, wherein the frame comprises a solid block and the open slide channel and the open barrel channel are formed in a surface of the solid block.

5. The racking device of claim 4, wherein the solid block comprises an aluminum material.

6. The racking device of claim 1, wherein the frame defines a planar surface, the open slide channel and the open barrel channel are formed in the planar surface, and each of the open slide channel and the open barrel channel extends to a respective maximum depth that is perpendicular to the planar surface.

7. The racking device of claim 1, wherein the width of the open slide channel continuously decreases from the entry end to the intersection.

8. The racking device of claim 7, wherein the width of the open slide channel continuously decreases at a constant rate from the entry end to the intersection.

9. The racking device of claim 1, wherein the open barrel channel has a maximum width of 0.5 inch.

10. The racking device of claim 1, wherein the open barrel channel has a maximum width of 0.625 inch.

11. The racking device of claim 1, wherein the open barrel channel has a maximum width of 0.750 inch.

12. A racking device for racking a slide of a rackable pistol, the racking device comprising a frame defining a slide channel and a barrel channel that intersect with one another at an intersection, wherein:

the slide channel has a length and a width, comprises an entry end, an exit end, and opposing channel edges, and is configured to accommodate the slide of a rackable pistol, the exit end intersects with the barrel channel, the slide channel width decreases in a direction from the entry end toward the intersection along at least a portion of the length of the slide channel, and the opposing channel edges are separated by a decreasing separation distance, in a direction toward the intersection, along at least a portion of the length of the slide channel;

the barrel channel has a length, comprises a barrel channel wall and opposing channel edges, and is configured to accommodate the barrel of a rackable pistol, the opposing channel edges being separated substantially equidistantly along the length of the barrel channel; and the slide channel has a groove formed therein that is configured to accommodate a pistol sight as a pistol slide is moved into the slide channel.

13. The racking device of claim 1, wherein the frame comprises a hollow member.

14. A racking device for racking a slide of a rackable pistol, the racking device comprising a frame defining a slide channel and a barrel channel that intersect with one another at an intersection, and a mounting clip that is configured to be attached to a waist belt, wherein:

the frame is mounted to the mounting clip;

the slide channel has a length and a width, comprises an entry end, an exit end, and opposing channel edges, and is configured to accommodate the slide of a rackable pistol, the exit end intersects with the barrel channel, the slide channel width decreases in a direction from the entry end toward the intersection along at least a portion of the length of the slide channel, and the opposing channel edges are separated by a decreasing separation distance, in a direction toward the intersection, along at least a portion of the length of the slide channel; and the barrel channel has a length, comprises a barrel channel wall and opposing channel edges, and is configured to accommodate the barrel of a rackable pistol, the opposing channel edges being separated substantially equidistantly along the length of the barrel channel.

15. The racking device of claim 1, further comprising a surface mounting bracket that is configured to be attached to a surface, and wherein the frame is mounted to the surface mounting bracket.

16. The racking device of claim 1, wherein the open barrel channel has a substantially arched-shaped cross-section along the length thereof, and two opposing, planar, parallel, sidewalls.

17. A system comprising a pistol clearing station and the racking device of claim 1, wherein the racking device is mounted in, on, or at, the pistol clearing station.

18. A system comprising a ballistics sampling station and the racking device of claim 1, wherein the racking device is mounted in, on, or at, the ballistics sampling station.

19. A method of racking a pistol having a slide and a barrel, the method comprising:

positioning the slide of the pistol in the open slide channel of the racking device of claim 1, such that sides of the slide of the pistol contact the open slide channel; and pushing the barrel of the pistol into the open barrel channel while the open slide channel prevents movement of the slide into the open barrel channel, to rack the pistol.

20. The method of claim 19, wherein the positioning and pushing are carried out with one hand.

* * * * *